US007527256B1

(12) United States Patent
Kaiping

(10) Patent No.: US 7,527,256 B1
(45) Date of Patent: May 5, 2009

(54) SHEET FEEDER

(76) Inventor: James C. Kaiping, 3626 Sweet Briar La., Columbia, IL (US) 62236

( * ) Notice: Subject to any disclaimer, the term of this patent is extended or adjusted under 35 U.S.C. 154(b) by 281 days.

(21) Appl. No.: 11/506,098

(22) Filed: Aug. 17, 2006

Related U.S. Application Data

(60) Provisional application No. 60/711,074, filed on Aug. 24, 2005.

(51) Int. Cl.
*B65H 5/00* (2006.01)
*B65H 3/04* (2006.01)

(52) U.S. Cl. ..... 271/10.03; 271/10.06; 271/34; 271/264

(58) Field of Classification Search ..... 271/34, 271/35, 10.03, 10.06, 264
See application file for complete search history.

(56) References Cited

U.S. PATENT DOCUMENTS 1,792,878 A * 2/1931 Wagner ..... 271/35
1,948,362 A * 2/1934 Staude ..... 271/35
5,277,417 A 1/1994 Moritake et al.
5,727,782 A 3/1998 Okada
6,364,305 B1 4/2002 Sussmeier et al.
6,607,191 B1 8/2003 Huang et al.

* cited by examiner

*Primary Examiner*—David H Bollinger
(74) *Attorney, Agent, or Firm*—Polster Lieder Woodruff & Lucchesi LC

(57) ABSTRACT

In a friction sheet feeder for feeding sheets to an inserting machine, paper guide extensions are provided, connected to paper guides on the feeder and positioned and adapted to guide each sheet both laterally and vertically to the necessary position for the inserting machinery to which it is attached. The extensions are mounted to the paper guides so as to be adjustable up and down to allow for precise delivery of the sheets being fed. Paper hold downs are attached to the paper guide extension and a sheet stop photo cue is attached permanently to at least one of the paper guide extension to stop sheet in precise position until the inserting equipment pulls the sheet away. Preferably, the paper guide extensions are mounted to the paper guides with a single locking bolt and nut.

7 Claims, 4 Drawing Sheets

SHEET FEEDER

CROSS-REFERENCE TO RELATED APPLICATIONS

Priority is claimed on provisional application Ser. No. 60/711,074 filed Aug. 24, 2005, incorporated herein by reference.

STATEMENT REGARDING FEDERALLY SPONSORED RESEARCH

Not Applicable.

BACKGROUND OF THE INVENTION

There are many sheet feeders available on the market that all are intended to serve a similar purpose to the sheet feeder of the present invention. Most of the feeders are designed to hold a stack of paper or other materials, hereinafter referred to as sheets, and to feed those sheets one at a time into automated equipment, such as printing, mailing, packaging and other machinery for high speed processing.

The sheet feeder of the present invention includes all of the unique features for which patent protection has been sought in my prior patent application. It also contains several new features for which am seeking patent protection.

Although hundreds of sheet feeder types are available for a wide variety of applications, the improvements in the feeder of the present invention deal primarily with sheet feeding for mail processing equipment, specifically swing arm type envelope inserting machines. Swing arm envelope inserting machines are used by high volume mailers to mechanically insert one or more sheets into envelopes at high speed. These types of inserting machines typically include two or more insert or sheet hoppers and an envelope hopper. These machines normally feed one sheet from each hopper and one envelope from the envelope hopper using vacuum assisted feet, which pull the bottom sheet or envelope from its respective hoppers.

Due to the lack of flexibility in this design, several, but a limited few friction sheet feeders similar to the one of the present invention have been marketed to the mailing industry for many years. Although these feeders perform reasonably well and give the inserting machinery more flexibility, they have several weaknesses that have been improved upon in the present invention.

Specifically, these feeders do not have sufficient sheet guides that extend through the entire machine, allowing sheets to skew as they exit the sheet separation area of the feeders. Additionally, an electronic photo cue that is attached to an arm extending from the end of the feeders must be adjusted to stop each sheet in the proper position for the inserting machine to be able to grab it and pull it away from the feeder. This photo eye must be manually adjusted and is prone to inconsistent set-up and operation. Finally, the prior art feeders do not have any means on the feeder itself to control the height of the sheet that is being delivered to the inserting machine, therefore the operator must install hold down fingers onto the inserting machine to guide the sheets into position. These hold downs are also problematic, as they need to be adjusted for different types of sheets.

BRIEF SUMMARY OF THE INVENTION

The sheet feeder of the present invention includes unique features that are designed to alleviate the aforementioned problems associated with prior art sheet feeders used on inserting equipment.

The sheet feeder includes a hopper that is used to hold a stack of sheets to be inserted. Friction feed belts that support part of the bottom of the stack of sheets serve to pull the bottom sheet away from the stack and transport that sheet toward the exit end of the feeder. Sheet separators that are positioned between two of the feed belts, press downward on the bottom sheet of the stack as it passes, buckling the piece downward away from the stack so that it can be easily pulled away from the stack. This method of separation, call "buckle separation" is included in my prior patent application. Paper guides that hold the stack of sheets in place in the hopper also extend all the way through the feeder adjacent the outer two feed belts to ensure straight delivery of the sheets to the inserting equipment. These guides also extend vertically downward below the surface of the feed belts ensuring that sheets cannot slide underneath the guides, as often happens on prior art feeders. These guides are also included in my co-pending prior patent application Ser. No. 11/145,855, filed Jun. 6, 2005, incorporated herein by reference.

Included on the end of these two sheet guides are extended guides that serve to hold the sheet straight laterally so the inserting machine can pull each sheet away consistently. Additionally, and in a major improvement over the prior art feeders, these extended guides also support the bottom of the sheet and hold the sheet at exactly the right height for the swing arm inserting machine to grab it consistently. These extension guides are attached to the end of the paper guides with a single bolt and locking nut, which allows the operator to easily adjust the delivery height of the sheets being fed for different inserting machinery. Aiding these guides in this process are two hold down straps that are attached to the extension guides and which serve to further guide each sheet to precise positioning up and down and side to side. These improvements, along with the complete paper guides described above effectively eliminate the inconsistent delivery of the prior art feeders as well as the need for the separate fingers attached to the inserting machine to guide the sheets into place. This results in fewer stoppages and quicker setup time.

An additional improvement over prior art feeders of this type is the mounting and performance of the sheet stop photo eye. The purpose of this photo eye, as on prior art feeders, is to recognize the leading edge of each sheet as it exits the feeder and to stop the feeder motor until the sheet is pulled away by the inserting machine. When the sheet has been removed from the path of the photo eye, the photo eye signals the motor to start again, feeding another sheet until it blocks the photo eye. The prior art feeders utilize a photo eye that is mounted on a long arm that extends from the bridge on the feeder. This photo eye must be adjusted so that it reflects off the leading edge of the sheet to stop the motor. Because this photo eye is on a separate arm, it must be adjusted after the feeder has been positioned on the inserting machine. The photo eye of the feeder of the present invention is attached to the paper guide extensions described above. Since the photo eye is mounted permanently on this extension, there is no need to independently adjust the eye to stop the sheet advance. With this improvement, the operator need not reposition this photo eye for different types of sheets.

BRIEF DESCRIPTION OF THE PREFERRED EMBODIMENT

Figure 1:
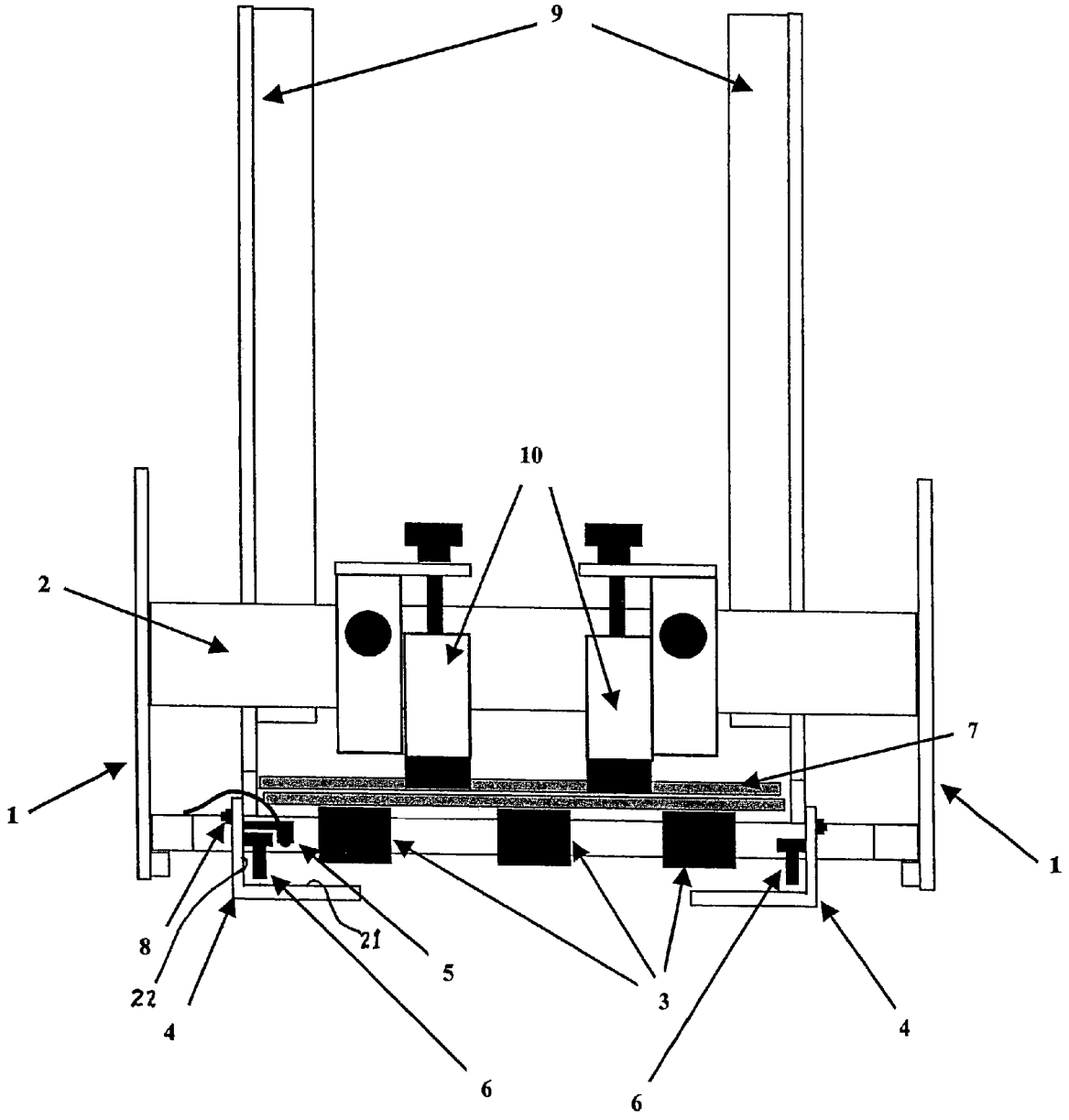
FIG. 1 is a view in elevation from the exit end of the feeder.

Referring to FIG. 1, the feeder of the preferred embodiment is made up of side plates 1 that are assembled to and support a bridge 2. Attached to the bridge 2 are paper guides 9, which serve to hold the stack of sheets 7 in a near vertical stack and also extend downward and through the feeder to the exit end of the feeder.

Attached to the paper guides 9 are two paper guide extensions 4 which include a vertical portion for lateral control of the sheets 7 and a horizontal portion for vertically controlling and guiding the sheets.

Attached to the paper guide extensions 4 are two hold down straps 6, which serve to hold each sheet downward against the horizontal portion of the paper guide extensions. These help to present each sheet at a consistent height to the mail inserting machine.

Attached to one of the paper guide extensions 4, is an electronic photo eye 5, which serves to stop the advancement of each sheet as the feeder motor advances it forward. When the sheet that is under the photo eye is pulled away by the inserter, the photo eye signals the motor to advance, feeding another sheet forward with the feed belts 3.

As the bottom sheet of the stack is advanced forward by the motor, the remaining sheets in the stack are held back by the sheet separators 10.

Figure 2:
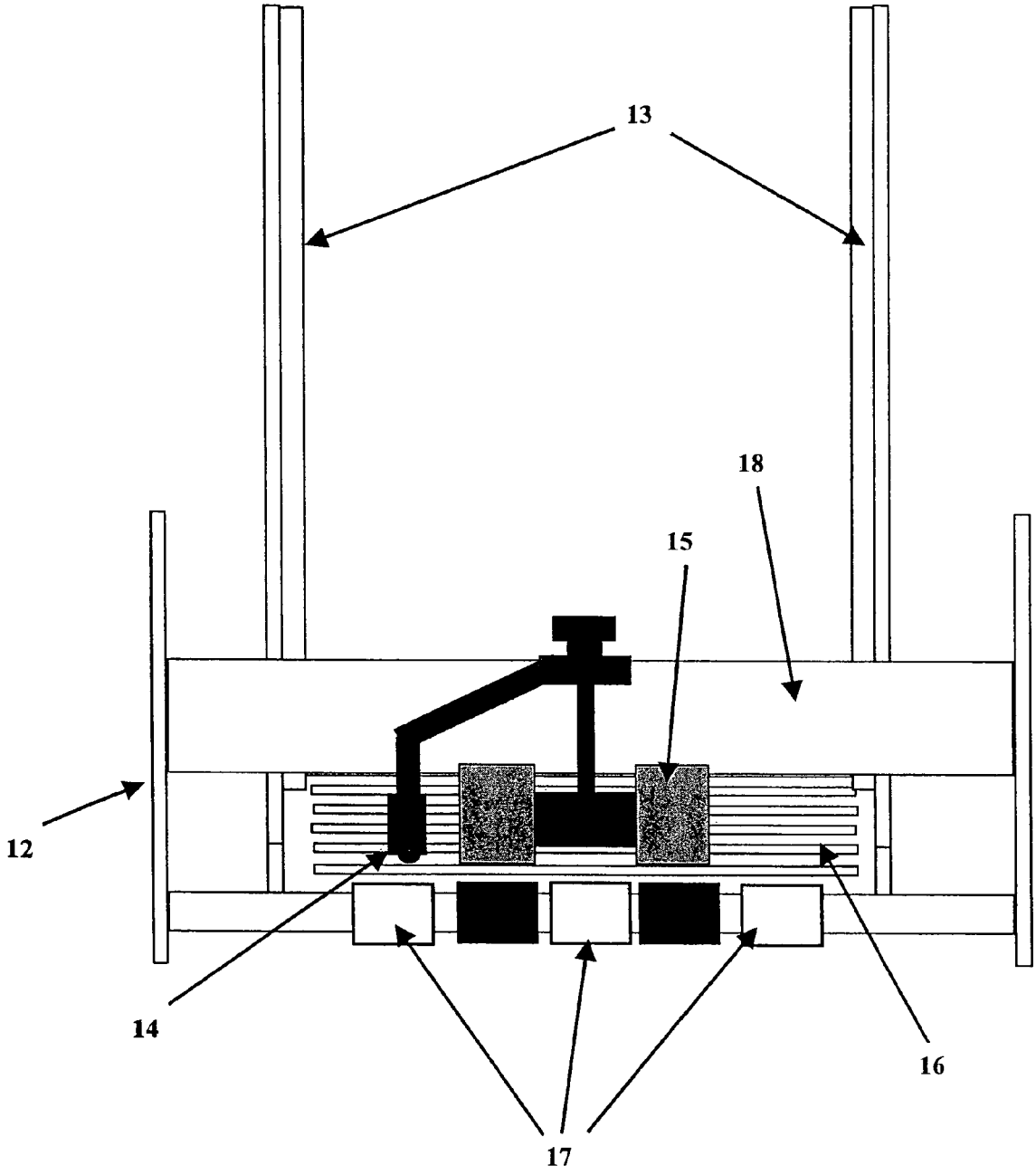
FIG. 2 is a view from the exit end of a prior art feeder.

Referring now to FIG. 2 in this prior art feeder drawing a bridge 18 is supported by and attached to two side plates 12. Attached to the bridge are two paper guides 13 that serve to support the stack of sheets 16. These paper guides do not extend all the way through the feeder as in the case of the feeder of the present invention, nor do they include any paper guide extensions.

As can be seen in FIG. 2, feed belts 17 serve to advance the bottom sheet of the stack while the rest of the stack is held back by the sheet separators 15. As the bottom sheet advances an electronic photo eye 14 sees the lead edge of the sheet and signals the motor to stop until the sheet is pulled away. Due to the lack of paper guide extensions and vertical support and guiding of each sheet, additional hold down fingers (not shown) must be added to the inserting machine to guide each sheet into place.

Figure 3:
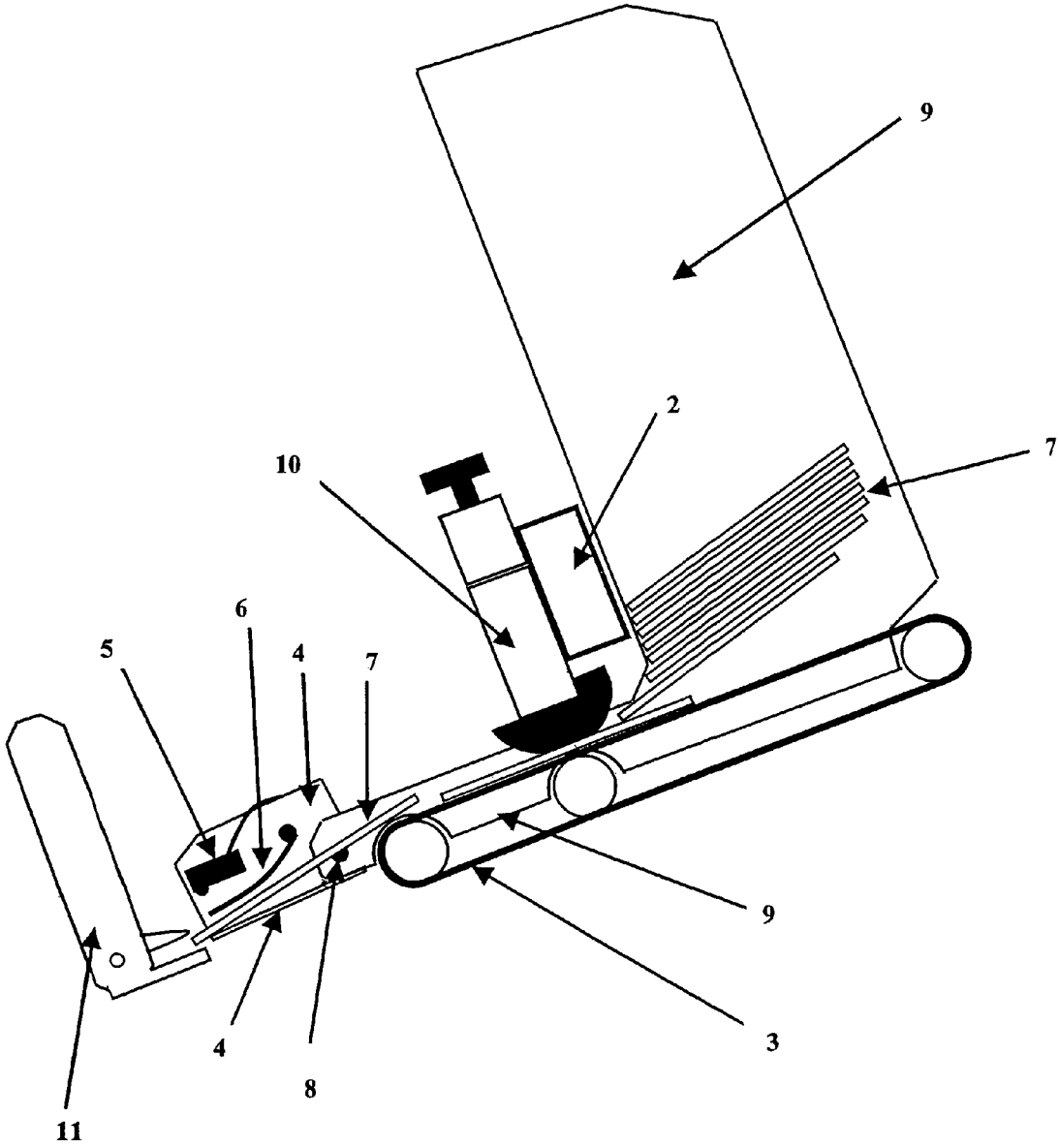
FIG. 3 is a cross-sectional view from the side of the feeder of the present invention with one side plate and one paper guide removed.

Referring now to FIG. 3, it can be seen that a stack of sheets 7 is held straight in a near vertical stack by the paper guides 9. As can be seen paper guides 9 extend downward and toward the exit end of the feeder offering lateral control of the sheets 7 as they advance through the feeder.

It can be seen in FIG. 3 that paper guide extensions 4 are attached to the paper guides 9 by a single bolt 8 allowing for the paper guide extensions to be swiveled up or down to adjust the height and angle of the sheet delivery.

It can be seen in FIG. 3 that the paper guide extensions 4 have a horizontal surface for vertical control of each sheet and a vertical surface for lateral control of each sheet. Additionally each paper guide extension has attached to it a paper hold down strap 6, which keeps the sheet at a precise height for delivery to the inserting machine's gripper device 11. This gripper device 11 pulls each sheet away from the feeder as it is delivered to the paper guide extensions by the feed belts 3.

As the bottom sheet 7 of the stack is pulled away from the stack by the feed belts 3, the electronic photo eye 5 recognizes the leading edge of the sheet and signals the drive motor (not shown) to stop. As the inserter gripper arm 11 moves in from left to right, the jaws of the gripper arm close on the sheet and the gripper arm then moves away from the feeder. When the trailing edge of the sheet is no longer under the photo-eye the photo-eye signals the motor to start and advance another sheet.

Figure 4:
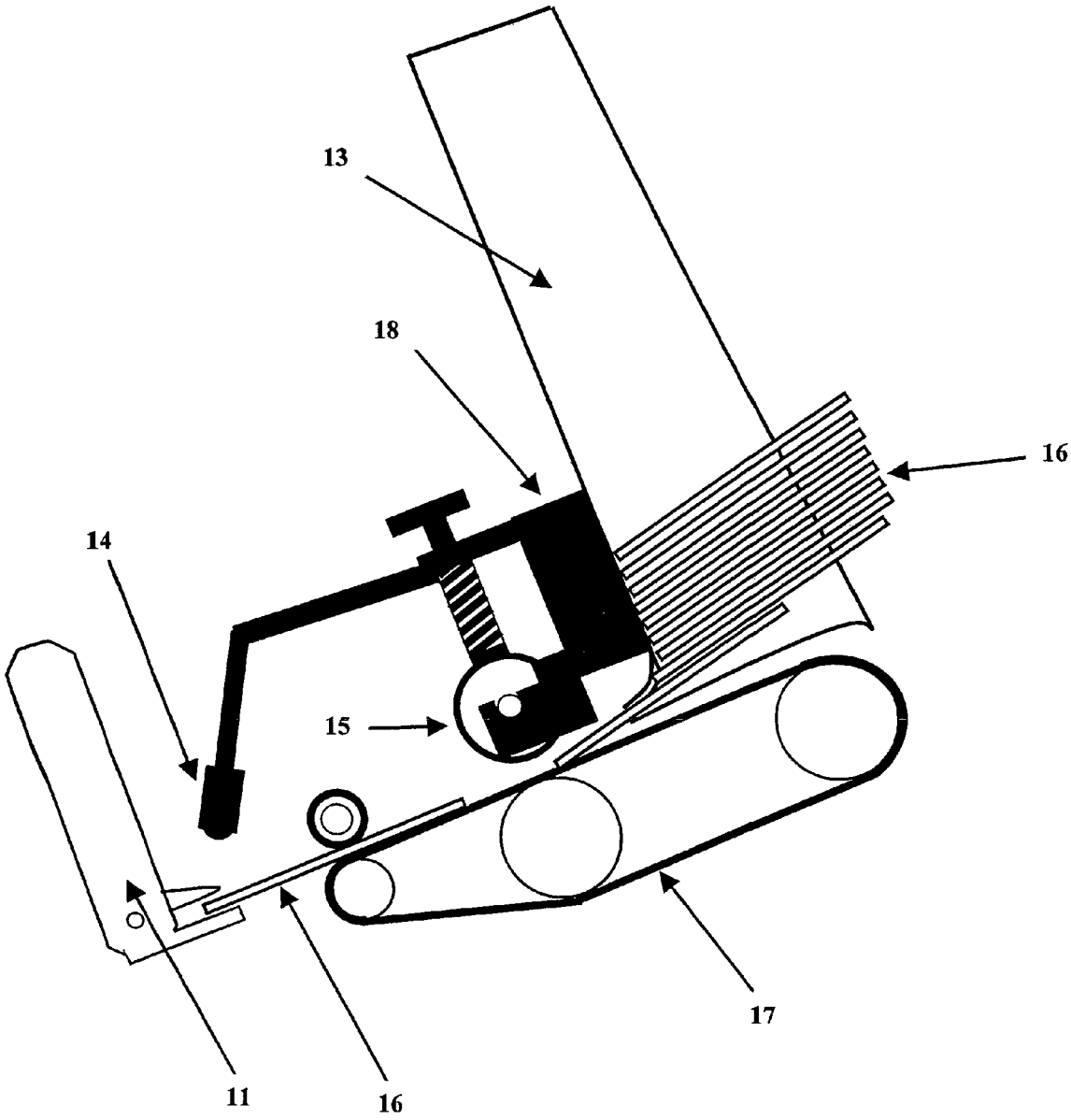
FIG. 4 is a cross-sectional side view of a prior art feeder of this type with one of the side plates and one of the paper guides removed.

Referring now to FIG. 4, that the paper guides 13 hold the stack of sheets 16 in a near vertical stack. It is important to note that the paper guides 13 do not extend below the surface of the feed belts 17 nor do they extend outward toward the exit end of the machine any more than below the bridge 18. This allows the bottom sheet 16 to skew as it exits the feeder so that it often is presented to the inserter gripper arm 11 crooked which affects performance. An electronic photo eye 14 attached to an adjustable arm is positioned well past the exit end of the feeder. This photo eye is to read the leading edge of the bottom sheet as it is advanced by the feed belts 17 wherein it signals the motor (not shown) to stop. As can be seen in FIG. 4, the prior art paper guides 13 do not have an extension as on the feeder of the present invention shown in FIG. 3, item 4, to offer lateral and horizontal positioning of the sheet. This means that lining up the sheet 16 in FIG. 4 so that it is presented to the open gripper jaw on the inserter arm 11 is a tricky and tedious process requiring some expertise. As seen in FIG. 4, a sheet separator 15 is lowered onto a single sheet so as to allow only one sheet through at a time.

Numerous variations in the construction of the feeder of this invention will occur to those skilled in the art in light of the foregoing disclosure. Merely by way of illustration, more than two sheet separators and three feed belts can be used, as described in my pending application Ser. No. 11/145,855, supra. The bolt 8 can be equipped with a wing nut or knurled nut to make loosening it easy and tightening secure. The head of the bolt can be countersunk so as not to interfere with the movement of the feeder sheets. These are merely illustrative.

The invention claimed is:

1. In a friction sheet feeder for feeding sheets to an inserting machine, the improvement comprising paper guide extensions connected to paper guides on said feeder alongside said sheets and positioned and adapted to guide each sheet both laterally and vertically to the necessary position for the inserting machinery to which it is attached, said paper guide extensions having a vertical section that guides the sheets laterally and a horizontal section that guides the sheets vertically.

2. The feeder of claim 1 wherein each of said paper guide extensions is mounted to a paper guide with a single locking bolt and nut and can be adjusted up and down allowing for precise delivery of the sheets being fed.

3. The feeder of claim 1 wherein paper hold-downs are attached to the paper guide extensions that serve to guide the sheets for precise vertical positioning.

4. The feeder of claim 1 wherein a sheet stop photo cue is attached permanently to at least one of said paper guide extensions to stop each sheet in precise position until the inserting equipment pulls the sheet away.

5. In a friction sheet feeder for feeding sheets to an inserting machine, the improvement comprising paper guide extensions connected to paper guides on said feeder and positioned and adapted to guide each sheet both laterally and vertically to the necessary position for the inserting machinery to which it is attached, said extensions being mounted to the paper guides and being adjustable up and down to allow for precise delivery of the sheets being fed, said paper guide extensions having a vertical section that guides the sheets laterally and a horizontal section that guides the sheets vertically, paper hold downs attached to the paper guide extensions that serve to guide the sheets for precise vertical positioning, and a sheet stop photo cue attached permanently to at least one of said paper guide extensions to stop each sheet in precise position until the inserting equipment pulls the sheet away.

6. The feeder of claim 5 wherein said extensions are mounted to the paper guides with a single locking bolt and nut.

7. The feeder of claim 6 wherein the feeder is a swing arm envelope inserting machine.

* * * * *